US009692186B2

(12) United States Patent
SooHoo et al.

(10) Patent No.: US 9,692,186 B2
(45) Date of Patent: Jun. 27, 2017

(54) HIGH-SPEED ELECTRICAL CONNECTOR

(71) Applicant: APPLE INC., Cupertino, CA (US)

(72) Inventors: Eric T. SooHoo, Sunnyvale, CA (US); Eric S. Jol, San Jose, CA (US); Ibuki Kamei, San Jose, CA (US)

(73) Assignee: Apple Inc., Cupertino, CA (US)

( * ) Notice: Subject to any disclaimer, the term of this patent is extended or adjusted under 35 U.S.C. 154(b) by 34 days.

(21) Appl. No.: 14/600,999

(22) Filed: Jan. 20, 2015

(65) Prior Publication Data

US 2016/0049753 A1 Feb. 18, 2016

Related U.S. Application Data

(60) Provisional application No. 62/036,873, filed on Aug. 13, 2014.

(51) Int. Cl.

| | |
|---|---|
| ***H01R 13/40*** | (2006.01) |
| ***H01R 13/66*** | (2006.01) |
| ***H01R 13/52*** | (2006.01) |
| ***H01R 4/02*** | (2006.01) |
| ***H01R 13/405*** | (2006.01) |
| ***H01R 13/6477*** | (2011.01) |

(Continued)

(52) U.S. Cl.

CPC ..... *H01R 13/665* (2013.01); *H01R 4/02* (2013.01); *H01R 13/405* (2013.01); *H01R 13/52* (2013.01); *H01R 13/6477* (2013.01); *H01R 12/57* (2013.01); *H01R 13/6658* (2013.01); *H01R 24/60* (2013.01)

(58) Field of Classification Search

CPC H01R 13/665; H01R 13/405; H01R 13/6477; H01R 13/52; H01R 4/02; H01R 12/57

USPC ..... 439/587, 589, 660, 936

See application file for complete search history.

(56) References Cited

U.S. PATENT DOCUMENTS

| | | | | |
|---|---|---|---|---|
| 7,852,169 | B2 | 12/2010 | Dutta | |
| 8,487,511 | B2 * | 7/2013 | Sinha | H03H 9/02086 310/320 |

(Continued)

FOREIGN PATENT DOCUMENTS

| | | | |
|---|---|---|---|
| CN | 102292876 | A | 12/2011 |
| WO | 2014-039108 | A1 | 3/2014 |

OTHER PUBLICATIONS

International Search Report and Written Opinion dated Dec. 14, 2015 for International Application No. PCT/US2015/039769, 21 pages.

(Continued)

*Primary Examiner* — Khiem Nguyen

(74) *Attorney, Agent, or Firm* — Kilpatrick Townsend and Stockton, LLP

(57) ABSTRACT

A high-speed electrical connector employs a plurality of electrical contacts held together by a dielectric frame. The contacts are electrically coupled to a substrate within the connector. A gasket may be disposed between the dielectric frame and the substrate and configured to block the flow of an overmold material between the dielectric frame and the substrate such that voids are formed between the contacts. The dielectric frame and the overmold may be made from materials containing silica aerogel. The voids and the aerogel materials result in reduced parasitic capacitance between the contacts enabling higher data transfer speeds.

25 Claims, 6 Drawing Sheets

(51) Int. Cl.
*H01R 12/57* (2011.01)
*H01R 24/60* (2011.01)

(56) References Cited

U.S. PATENT DOCUMENTS

| | | | |
|---|---|---|---|
| 8,517,751 | B1 | 8/2013 | Golko et al. |
| 2003/0224649 | A1 | 12/2003 | Vista, Jr. et al. |
| 2011/0263158 | A1 | 10/2011 | Nishikata et al. |
| 2014/0073206 | A1 | 3/2014 | Golko et al. |
| 2015/0072557 | A1 | 3/2015 | Kamei et al. |

OTHER PUBLICATIONS

International published application filed on Feb. 18, 2016; Published as Publication No. 2016025106.
(Taiwan) Notice of published application filed on Apr. 1, 2016; Published as Publication No. 201613191.
(WO) International Re-Published Application, Published as Publication No. 2016025106 (A8), Feb. 18, 2016.
(Taiwan) Office Action issued Oct. 21, 2016 in 7 pages.
PCT/US2015/039769, "Invitation to Pay Additional Fees and Partial Search Report", mailed Oct. 8, 2015, 7 pages.
International Preliminary Report on Patentability for PCT Application No. PCT/US2015/039769, dated Feb. 23, 2017 in 15 pages.

* cited by examiner

HIGH-SPEED ELECTRICAL CONNECTOR

CROSS-REFERENCE TO RELATED APPLICATIONS

The present application claims priority to U.S. Provisional Application No. 62/036,873, filed Aug. 13, 2014, titled "HIGH SPEED ELECTRICAL CONNECTOR", which is hereby incorporated by reference in its entirety for all purposes.

FIELD

The present invention relates generally to electrical connectors and in particular to electrical connectors employed in applications requiring high-speed data transmission.

BACKGROUND

A wide variety of electronic devices are available for consumers today. Many of these devices have connectors that facilitate communication with and/or charging of a corresponding device. These connectors often interface with other connectors through cables that are used to connect devices to one another. Sometimes, connectors are used without a cable to directly connect the device to another device, such as a charging station or a sound system.

As smart-phones, media players and other electronic devices become more sophisticated, a limiting factor on the performance of a particular device may be the rate at which data can be transferred to and from the device. As an example, data transfer cables having connectors at either end are sometimes used to exchange data with portable media devices. The usefulness of such portable media devices may be limited by the rate at which data, such as a file containing a movie, may be transferred to the device. More sophisticated electronic devices may be able to hold numerous movie files and the more expedient the file transfer the more convenient the device may be for the user.

New connectors such as the connector employed in the data transfer cable just described as well as other connectors, may require new features and/or changes to commonly used connector components to support increased data transfer rates.

SUMMARY

Embodiments of the invention pertain to high-speed electrical connectors for use with a variety of electronic devices. In some embodiments, the electrical connectors are configured to be attached to a cable while in other embodiments they may be mounted in a docking station or other device. The increased speed enables faster data transfer between electronic devices and an improved user experience.

Some embodiments of the present invention relate to high-speed electrical connectors that have one or more contact assemblies integrated within the connector. Each contact assembly has a plurality of electrical contacts disposed in a dielectric frame. The dielectric frame may be defined by a perimeter that encompasses the plurality of contacts. The contacts may be electrically coupled to a substrate also integrated within the connector and the substrate may be electrically coupled to the cable or docking station. A gasket may be disposed along the perimeter of the dielectric frame and compressed between the dielectric frame and the substrate. The gasket may be made from a compressible material and configured to form a seal between the dielectric frame and the substrate. An overmold may encapsulate the dielectric frame, the contacts and the substrate. In one embodiment the gasket may prevent the overmold from flowing between the substrate and the dielectric frame between the plurality of electrical contacts. As a result, voids "air pockets" may be formed between the plurality of electrical contacts resulting in reduced parasitic capacitance and higher data transfer speed.

In further embodiments, portions of the gasket "fingers" may be disposed between each of the plurality of electrical contacts. The gasket may be made from a relatively low dielectric constant material such as expanded polytetrafluoroethylene (PTFE), resulting in reduced parasitic capacitance and a higher data transfer speed for the connector.

In other embodiments, the dielectric frame and/or the overmold material may be made from a plastic that includes silica aerogel. The silica aerogel may be primarily composed of air and may reduce the dielectric constant of the dielectric frame and/or the overmold. The reduced dielectric constant may result in reduced parasitic capacitance and a higher data transfer speed for the connector.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

Certain embodiments of the present invention relate to electrical connectors. While the present invention can be useful for a wide variety of electrical connectors, some embodiments of the invention are particularly useful for electrical connectors that can be used in high-speed data transmission, as described in more detail below.

Figure 1:
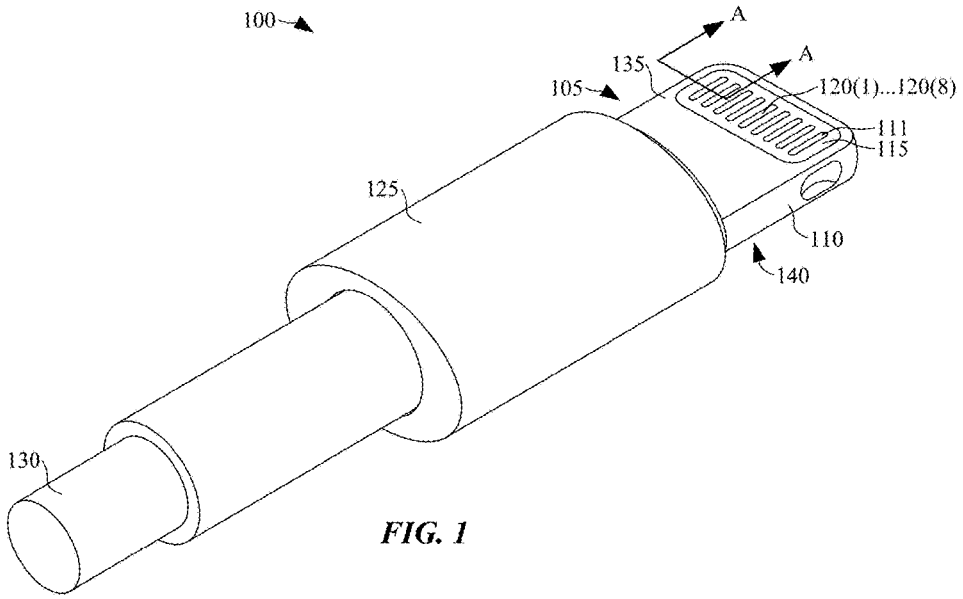
FIG. 1 is a front perspective view of a high-speed electrical connector according to an embodiment of the invention.

FIG. 1 is a simplified perspective view of an exemplary plug connector 100 that may benefit from embodiments of the invention. Plug connector 100 may be employed in a data transfer cable or in a device such as a docking station. Plug connector 100 includes a connector tab 105 that is sized to be inserted into a cavity in a corresponding receptacle connector (not shown). Tab 105 includes a metal ground ring 110 that surrounds a contact region 111. A contact assembly 115 is disposed within contact region 111 and may contain a first plurality of external elongated electrical contacts 120(1) . . . 120(8) retained in a dielectric frame (illustrated in greater detail below). This particular embodiment has eight electrical contacts, however other embodiments may have more or less electrical contacts. Contacts 120(1) . . . 120(8) need not be external and may have a variety of shapes such as, but not limited to square, round, leaf springs or cantilevered beams. Connector 100 further comprises a connector body 125 having tab 105 coupled to and extending out of a first end of the body and a cable bundle 130 extending out of a second, opposite, end of the body. In some embodiments connector tab 105 may be double sided, including first and second surfaces 135, 140, respectively where each surface has one or more electrical contacts, as discussed in more detail below.

Figure 2A:
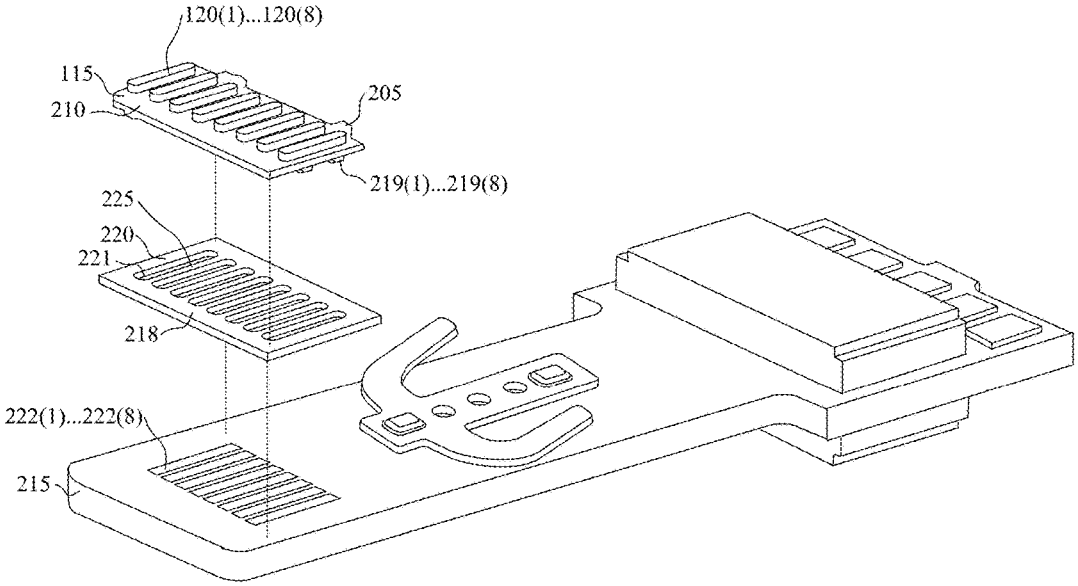
FIG. 2A is an exploded view of components within the electrical connector shown in FIG. 1.

FIG. 2A is an exploded view of the internal construction of connector 100. In this illustration metal ground ring 110, body 125 and cable bundle 130 have been removed for clarity. Contact assembly 115 and gasket 218 are shown above substrate 215 in a preassembled position. Contact assembly 115 includes plurality of electrical contacts 120(1) . . . 120(8) that are retained in a first dielectric frame 205, as will be shown in greater detail below. First dielectric frame 205 has a perimeter 210 that encompasses first plurality of electrical contacts 120(1) . . . 120(8). Electrical contacts 120(1) . . . 120(8) may each have one or more lower portions 219(1) . . . 219(8) that protrude below dielectric frame 205. Gasket 218 may have a perimeter portion 220 and some embodiments may have one or more fingers 225 that create one or more openings 221 aligned with the one or more lower portions 219(1) . . . 219(8) of electrical contacts 120(1) . . . 120(8). The one or more openings 221 in gasket 218 may also be aligned with a plurality of bonding pads 222(1) . . . 222(8) on substrate 215.

During assembly, gasket 218 may be disposed on substrate 215 such that the one or more openings 221 are aligned with the plurality of bonding pads 222(1) . . . 222(8) on substrate 215. Contact assembly 115 may then be disposed on gasket 218 such that the one or more lower portions 219(1) . . . 219(8) of electrical contacts 120(1) . . . 120(8) extend through the one or more openings 221 in gasket 218 and are electrically coupled to the plurality of bonding pads 222(1) . . . 222(8) on substrate 215.

Figure 2B:
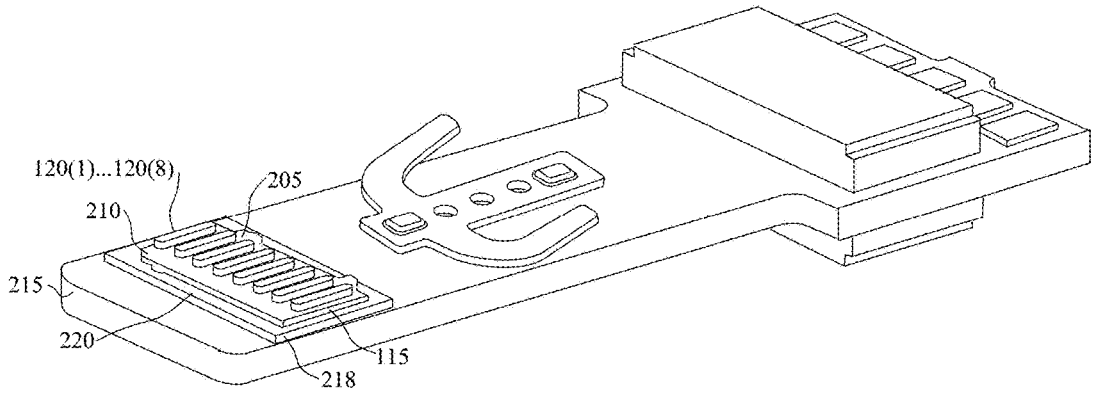
FIG. 2B is an assembled view of components within the electrical connector shown in FIG. 1.

FIG. 2B illustrates gasket 218 and contact assembly 115 in the assembled position on substrate 215. More specifically, perimeter portion 220 of gasket 218 may be compressed between dielectric frame 205 of contact assembly 115 and substrate 215. Similarly, one or more fingers 225 (see FIG. 2A) of gasket 218 may extend between the one or more lower portions 219(1) . . . 219(8) (see FIG. 2A) of electrical contacts 120(1) . . . 120(8) and be compressed between dielectric frame 205 of contact assembly 115 and substrate 215. Gasket 218 may be made from a compliant material such as expanded polytetrafluoroethylene (PTFE), as discussed in more detail below. Compressed gasket 218 may prevent the flow of overmold material between contact assembly 115 and substrate 215 during subsequent manufacturing processes, as illustrated in greater detail below.

Figure 2C:
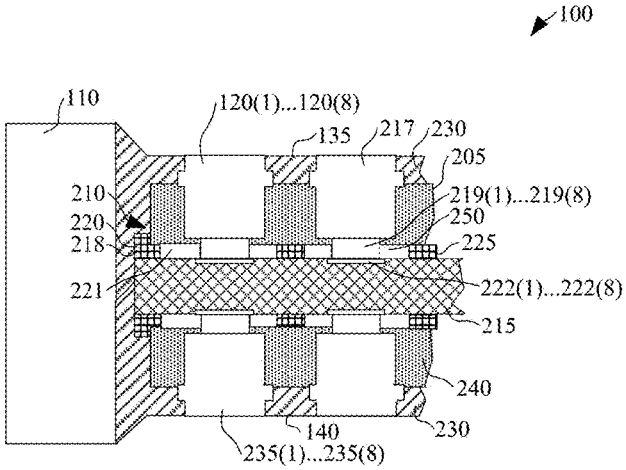
FIG. 2C is a partial cross-sectional view of the electrical connector shown in FIG. 1.

FIG. 2C is a partial cross-section of the fully assembled connector 100 illustrated in FIG. 1, denoted by section A-A. First dielectric frame 205 retains first plurality of electrical contacts 120(1) . . . 120(8). Lower portions 219(1) . . . 219(8) of electrical contacts 120(1) . . . 120(8) protrude below dielectric frame 205 and are in electrical contact with plurality of bonding pads 222(1) . . . 222(8) on substrate 215. Substrate 215 may retain one or more electronic components (not shown). Gasket 218 may be compressed between first dielectric frame 205 and substrate 215. More specifically, gasket 218 may have a perimeter portion 220 and some embodiments may have one or more fingers 225 that are compressed between first dielectric frame 205 and substrate 215. An overmold 230 may encapsulate an upper portion 217 of first plurality of electrical contacts 120(1) . . . 120(8), first dielectric frame 205, substrate 215 as well as other portions of connector 100 as described in more detail below. Gasket 218 may preclude overmold 230 from flowing between first dielectric frame 205 and substrate 215, creating one or more voids in the region of gasket 218 openings 221, as discussed in more detail below.

In some embodiments, overmold 230 may be formed by injecting molten plastic within metal ground ring 110. Gasket 218 and/or gasket fingers 225 may prevent overmold 230 from flowing between dielectric frame 205 and substrate 215 such that one or more "voids" 250 are formed adjacent to and/or in-between each of first plurality of electrical contacts 120(1) . . . 120(8) in the region of openings 221. As used herein, a void shall mean an area that is substantially vacant of materials such as gasket 218, gasket fingers 225 and/or overmold 230. Further, a void may or may not be filled with a gas such as air and in some cases may contain moderate amounts of other materials such as solder flux residue. In some embodiments, voids 250, gasket 218 and/or gasket fingers 225 may be used to improve the data transmission rate of connector 100, as described in more detail below.

Most electrical connectors, such as connector 100 (see FIG. 1), have insulating dielectrics (e.g., overmold 230 and first dielectric frame 205) to separate the electrical conductors (e.g., first plurality of electrical contacts 120(1) . . . 120(8)) from one another. The insulating dielectrics provide electrical isolation to prevent the conductors from shorting together as well as mechanical support to hold the conductors in place. In some embodiments, the conductors may be close to one another and may be used to transmit high-speed data using a differential pair architecture where the two conductors transmit data by rapidly changing their relative voltage potential.

When two conductors (e.g., each of first plurality of electrical contacts 120(1) . . . 120(8)) at different voltage potentials are close to one another, they are affected by each other's electric field and store opposite electric charges like a capacitor. The result is the generation of parasitic capacitance. Changing the voltage potential between the conductors requires a current into or out of the conductors to charge or discharge them resulting in reduced voltage potential switching speed and increased energy losses. Capacitance can be calculated if the geometry of the conductors and the dielectric properties of the dielectric between the conductors are known. For example, the capacitance of a parallel-plate capacitor constructed of two parallel plates both of area A separated by a distance d is approximately equal to the following:

$$C = \epsilon_r \epsilon_0 \frac{A}{d}$$

Where:

C is the capacitance, in Farads;

A is the area of overlap of the two plates, in square meters;

$\in_r$ is the relative static permittivity (sometimes called the dielectric constant) of the dielectric between the plates (for a vacuum, $\in_r=1$);

$\in_0$ is the electric constant ($\in_0 \approx 8.854 \times 10^{-12}$ F $m^{-1}$); and d is the separation between the plates, in meters.

Therefore, replacing one or more of the insulating dielectrics (e.g., overmold 230 and first dielectric frame 205) disposed between electrical contacts (e.g., first plurality of electrical contacts 120(1) . . . 120(8)) with a material or medium having a reduced dielectric constant will reduce the parasitic capacitance. As discussed above, the reduction parasitic capacitance enables faster data transmission speeds and lower energy losses. Since the dielectric constant of a vacuum and air are by definition the lowest possible dielectric constant mediums available, at approximately 1, the more space between the conductors (e.g., first plurality of electrical contacts 120(1) . . . 120(8)) filled by air or by a lower dielectric constant material, the higher the potential data transmission speed of connector 100.

In some embodiments the area between each of electrical contacts 120(1) . . . 120(8) may be filled with more than one material and/or medium. In these embodiments the effective dielectric constant may be the aggregate of the dielectric constants of the constituent materials. Thus, changing the dielectric constant of one or more of the constituent materials may effect the effective dielectric constant and the related data transmission rate of connector 100.

Referring still to FIG. 2C, in further embodiments, the effective dielectric constant of the material between each of first plurality of electrical contacts 120(1) . . . 120(8) may be reduced by fabricating gasket 218 and/or gasket fingers 225 from a material having a reduced dielectric constant as compared to overmold 230. That is, by filling a portion of the space between lower portions 219(1) . . . 219(8) of first plurality of electrical contacts 120(1) . . . 120(8) with gasket 218 and/or gasket fingers 225 instead of overmold 230, the effective dielectric constant may be reduced. In some embodiments gasket 218 and/or gasket fingers 225 may be manufactured from a low dielectric constant material such as expanded PTFE known as "Teflon® foam". In other embodiments a different material may be used such as an elastomer or silicone material, either of which may be a foam having substantial air pockets. Myriad materials may be used to reduce the effective dielectric constant of the area between each of first electrical contacts 120(1) . . . 120(8). In one embodiment the dielectric constant of overmold 230 is between 4-8. In another embodiment the dielectric constant of overmold 230 is between 5-7. In further embodiments the dielectric constant of overmold 230 is approximately 6. In one embodiment the dielectric constant of gasket 218 and/or gasket fingers 225 is between 1.1-3. In another embodiment the dielectric constant of gasket 218 and/or gasket fingers 225 is between 1.1-2. In further embodiments the dielectric constant of gasket 218 and/or gasket fingers 225 is approximately 1.3.

In other embodiments the area between each of lower portions 219(1) . . . 219(8) of plurality of contacts 120(1) . . . 120(8) may be filled with a combination of gasket material and voids. For example, in one embodiment, gasket fingers 225 may fill the entire width between lower portions 219(1) . . . 219(8) of each of plurality of contacts 120(1) . . . 120(8) and very small voids 250 may be created. In further embodiments gasket fingers 225 may fill only a small portion of the width between lower portions 219(1) . . . 219(8) of each of plurality of contacts 120(1) . . . 120(8) and large voids may be created. More specifically, in some embodiments gasket fingers 225 may fill less than half of the area between lower portions 219(1) . . . 219(8) of each of first plurality of contacts 120(1) . . . 120(8) while in other embodiments the gasket fingers may fill more than half of the area. In further embodiments gasket fingers 225 may be disposed between some of lower portions 219(1) . . . 219(8) of first plurality of contacts 120(1) . . . 120(8), while in other embodiments gasket fingers may be disposed between all of lower portions 219(1) . . . 219(8) of first plurality of contacts 120(1) . . . 120(8). For example, in some embodiments only two contacts (e.g., 120(2) and 120(3)) may be used for high-speed data transmission so a single gasket finger 225 may be disposed only between those two contacts.

In some embodiments the percent compression of gasket 218 and/or gasket fingers 225 may be optimized to have as low a dielectric constant as possible, while still providing an adequate seal to keep out the relatively higher dielectric constant overmold 230. This may be beneficial for compressible gasket materials that are filled with air pockets since when under compression the size and/or quantity of air pockets within the material may be reduced, which commensurately increases the dielectric constant of the material. Thus, the compression of gasket 218 and/or gasket fingers 225 may be minimized so that an adequate seal is formed at a minimal compression.

In further embodiments gasket 218 may be used only around periphery 210 of first dielectric frame 205. That is, in some embodiments there may be no gasket fingers 225 disposed between lower portions 219(1) . . . 219(8) of first plurality electrical contacts 120(1) . . . 120(8). In such embodiments perimeter portion 220 of gasket 218 may prevent overmold 230 from flowing between first dielectric frame 205 and substrate 215, thereby creating voids 250 composed primarily of air between lower portions 219(1) . . . 219(8) of each of first plurality electrical contacts 120(1) . . . 120(8). In these embodiments, because gasket 218 is not disposed between electrical contacts, its dielectric constant may have little effect on the electrical performance of connector 100 (see FIG. 1). Instead, air separates lower portions 219(1) . . . 219(8) of each of first plurality electrical contacts 120(1) . . . 120(8) which has a dielectric constant of 1. Therefore, in such embodiments, the dielectric constant of gasket 218 may have a negligible impact on the data transmission speed of connector 100 (see FIG. 1) and materials having a relatively high dielectric constant may be used for gasket 218. Thus, in these embodiments any compliant material may be used for gasket 218, such as, but not limited to an elastomer or a silicone.

Figure 3:
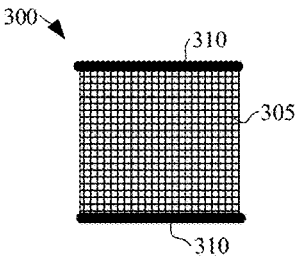
FIG. 3 is a partial cross-sectional view of a gasket with reinforcement layers that may be used in the electrical connector shown in FIG. 1.

FIG. 3 illustrates a partial cross-sectional view of an alternative embodiment of gasket material 300 that may be used to make gasket 218 and/or gasket finger 225. Gasket material 300 is composed of a compressible material 305 with one or more support layers 310 disposed on one or more faying surfaces. Compressible material 305 may be any material, such as expanded PTFE, as discussed above, to provide a low dielectric constant between electrical contacts 120(1) . . . 120(8). In other embodiments, compressible material 305 may be only used around perimeter portion 220 of gasket 218 and used to prevent overmold 230 from flowing between dielectric frame 205 and substrate 215. FIG. 3 illustrates support layers 310 on both faying surfaces of gasket 300, however in some embodiments the support layer may be disposed on only one surface. Support layers 310 may include a material that is relatively rigid, such as a fiber reinforcement, so it provides mechanical support for fabrication, transportation, placement and processing of gasket 218 and/or gasket fingers 225.

In further embodiments, support layer 310 may only be disposed around perimeter of gasket 218, and gasket fingers 225 may have no support layer. In other embodiments one or more support layers 310 may be configured to be removable after gasket and/or gasket fingers 225 are placed on substrate 215 or first dielectric frame 205. That is, in some embodiments one or more support layers 310 may be used as a temporary manufacturing and assembly aids and removed before final assembly and overmolding. In other embodiments one or both faying surfaces of gasket 218 and/or gasket fingers 225 may have an adhesive to aid placement and retention to substrate 215 during assembly.

Referring back to FIG. 2B, in further embodiments, gasket 218 may be replaced by an epoxy or other material that is disposed around perimeter 210 of first dielectric frame 205. As an example, a bead of epoxy may be dispensed on substrate 215 such that perimeter 210 of first dielectric frame 205 is sealed, preventing overmold 230 from flowing between the first dielectric frame and the substrate. In other embodiments first dielectric frame 205 may be formed such that it has a lip disposed around perimeter 210 where the lip is positioned close enough to substrate 215 to prevent overmold 230 (see FIG. 2C) from flowing between first dielectric frame 205 and the substrate. Myriad methods may be used to prevent overmold 230 from flowing between first dielectric frame 205 and substrate 215.

Further embodiments may employ materials for first dielectric frame 205 and/or overmold 230 that have reduced dielectric constants to reduce the effective dielectric constant between each of plurality of contacts 120(1) . . . 120(8). In one embodiment, dielectric frame 205 and/or overmold 230 may employ a filled plastic material where the filler comprises an aerogel. The aerogel may be a porous material derived from a gel, in which the liquid component of the gel has been replaced with a gas. The result may be a solid with extremely low density composed predominantly of air. In some embodiments the filler may comprise a silica aerogel. In further embodiments particulates of aerogel may be dispersed within the plastic material used for first dielectric frame 205 and/or overmold 230. In one embodiment first dielectric frame 205 is manufactured from a liquid crystal polymer that is filled with particulates of aerogel, however in other embodiments other plastic materials may be employed, and are within the scope of this disclosure. In some embodiments the percentage of aerogel filler reduces the dielectric constant of first dielectric frame 205 to a value between 1-4. In other embodiments it reduces the dielectric constant to a value between 1-3. In further embodiments it reduces the dielectric constant to a value between 1-2.

In one embodiment overmold 230 may be manufactured from a nylon or polyoxymethylene (POM) that is filled with particulates of aerogel, however in other embodiments other plastic materials may be employed and are within the scope of this disclosure. In some embodiments the percentage of aerogel filler reduces the dielectric constant of overmold 230 to a value between 1-6. In other embodiments it reduces the dielectric constant to a value between 1-4. In further embodiments it reduces the dielectric constant to a value between 1-2.

Myriad combinations of materials and design features may be employed to reduce the effective dielectric constant between plurality of contacts 120(1) . . . 120(8). In some embodiments gasket 218 and/or gasket fingers 225 may be used alone. In other embodiments they may be used with first dielectric frame 205 manufactured from a plastic having aerogel particulates. In some embodiments gasket 218 and/or gasket fingers 225 may be used with overmold 230 manufactured from a plastic having aerogel particulates. In further embodiments first dielectric frame 205 manufactured from a plastic with aerogel particulates may be used by itself. In other embodiments overmold 230 manufactured from a plastic with aerogel particulates may be used by itself. In yet further embodiments first dielectric frame 205 manufactured from a plastic having aerogel particulates may be used with overmold 230 also having aerogel particulates. In yet further embodiments first dielectric frame 205 manufactured from a plastic having aerogel particulates may be used with overmold 230 also having aerogel particulates along with gasket 218 and/or gasket fingers 225. Myriad combinations of materials may be used to reduce the effective dielectric constant between plurality of contacts 120(1) . . . 120(8) and are within the scope of this disclosure.

Referring to FIG. 2C, as discussed above, some embodiments of connector 100 may be double sided and have second surface 140 having second plurality of contacts 235(1) . . . 235(8), also attached to substrate 215. Overmold 230 may encapsulate a portion of first plurality of electrical contacts 120(1) . . . 120(8), first dielectric frame 205, substrate 215, second dielectric frame 240 and a portion of second plurality of contacts 235(1) . . . 235(8). Similar features may be employed as described herein to reduce the dielectric constant of the area between each of second plurality of contacts 235(1) . . . 235(8).

Figure 4:
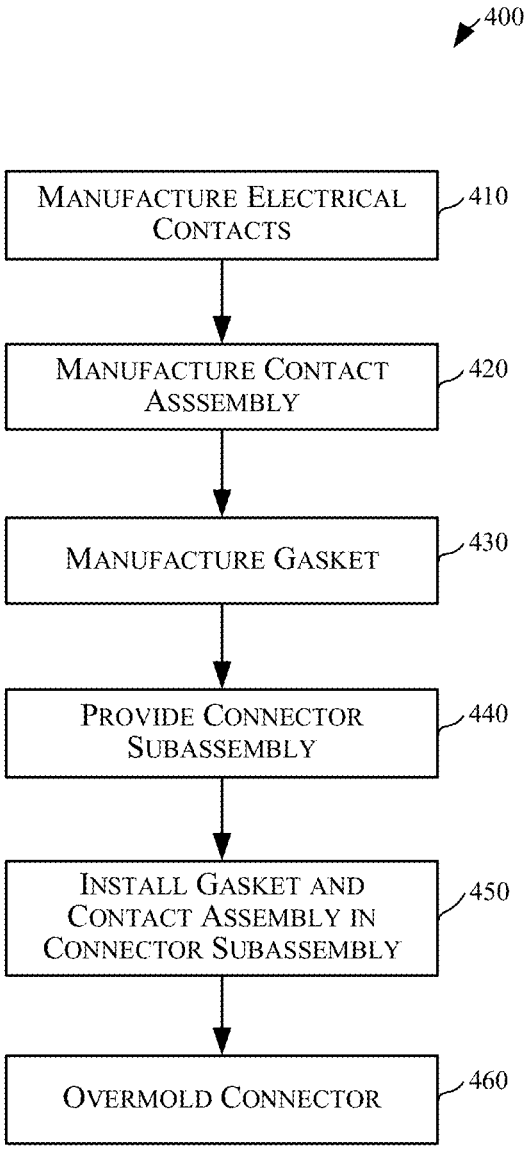
FIG. 4 is a method for manufacturing a high-speed electrical connector according to an embodiment of the invention.

Plug connector 100 (see FIG. 1) may be manufactured with myriad processes, one of which is illustrated in FIG. 4 and FIGS. 5-8. FIG. 4 is a flow chart that illustrates the general steps associated with the manufacture and assembly of high-speed connector 100 (see FIG. 1) according to one embodiment of the invention. The process steps may be performed in any order and one or more steps may be eliminated. FIGS. 5-8 depict plug connector 100 (see FIG. 1) at the various stages of manufacture set forth in FIG. 4.

Figure 5:
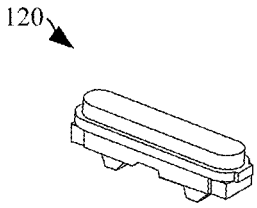
FIG. 5 is a side perspective view of a contact assembly that may be used in the electrical connector shown in FIG. 1.

Now referring to FIG. 5, the manufacture of connector 100 may be initiated with the fabrication of electrical contacts 120 (FIG. 4, step 410). In step 410, electrical contact 120 (see FIG. 5) may be fabricated using a variety of techniques such as, for example, stamping, molding, forming, cutting or casting. Electrical contact 120 may also have one or more layers of metallic plating, such as, for example, nickel, gold, palladium, tin, copper or silver. An example manufacturing process for one embodiment of contact may be found in U.S. patent application Ser. No. 13/607,554 filed on Sep. 7, 2012 which is incorporated by reference herein in its entirety for all purposes.

Figure 6:
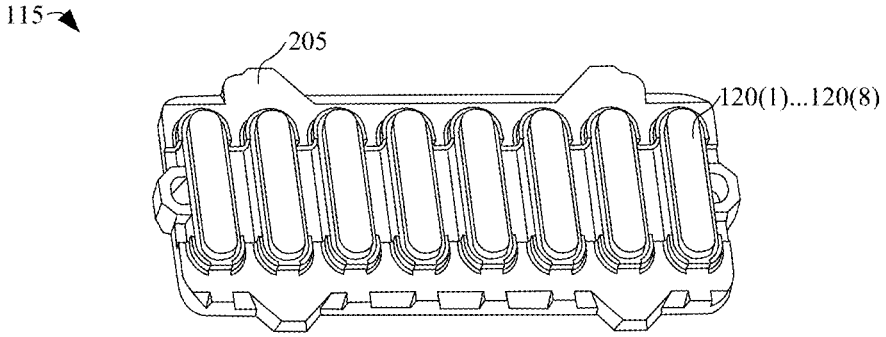
FIG. 6 is a front perspective view of an electrical contact assembly that may be used in the electrical connector shown in FIG. 1.

The next step of assembly may involve insert-molding a dielectric plastic frame 205 around one or more contacts 120(1) . . . 120(8) (FIG. 4, step 420; FIG. 6) to form contact assembly 115. One embodiment has eight contacts 120(1) . . . 120(8) that are insert-molded and secured by dielectric frame 205. Insert-molding may be accomplished with a reel-to-reel system or any other type of molding machine. An example manufacturing process for one embodiment of dielectric plastic frame may be found in U.S. patent application Ser. No. 13/607,554 filed on Sep. 7, 2012 which was incorporated by reference above. In one embodiment, one molding die is stationary and another die travels in up and down cycles repeatedly. With each down cycle, the system may perform an insert-molding operation around contacts 120(1) . . . 120(8) (FIG. 6). With each up cycle, additional contacts 120(1) . . . 120(8) may be advanced into the system for the next molding operation. This cycle may repeat several times per minute. In some embodiments, dielectric frame 205 may be manufactured with a plastic filled with aerogel particulates.

Figure 7:
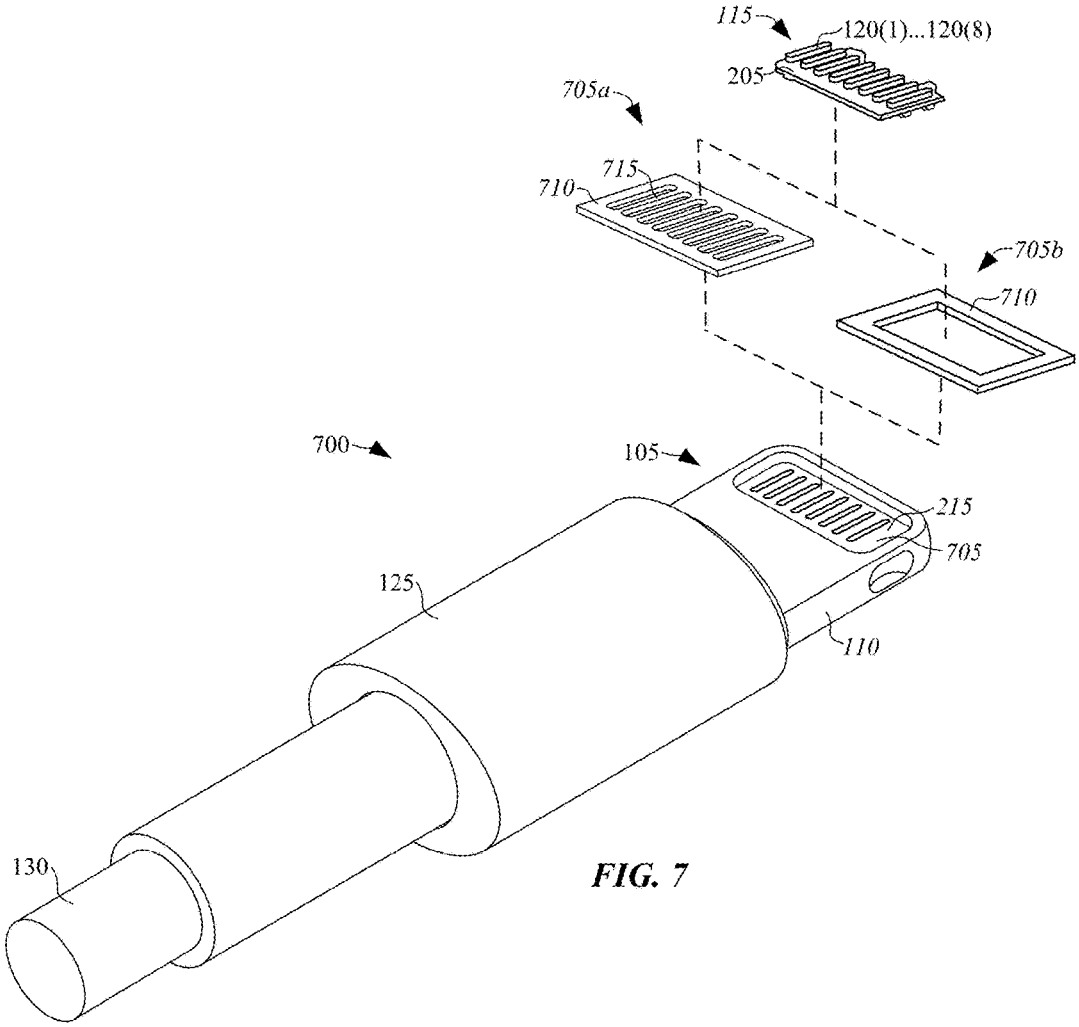
FIG. 7 is a rear perspective view of a partially assembled electrical connector shown in FIG. 1.

The next step of assembly may involve manufacturing gasket 705*a* or 705*b*, (FIG. 4, step 430; FIG. 7). Referring now to FIG. 7, there may be two alternative gasket designs that may be used while in other embodiments no gasket may be used. One gasket design, gasket 705*a*, may have an perimeter portion 710 with one or more fingers 715 disposed within the perimeter portion. Fingers 715 may be aligned between contacts 120(1) . . . 120(8), as discussed above. In alternative embodiments, a second gasket design, gasket 705*b*, may be used having only a perimeter portion 710 that seals periphery of dielectric frame 205 to substrate 215. As discussed above, gasket 705*a*, 705*b* may be manufactured from a compressible material having a low dielectric constant such as expanded PTFE. In further embodiments other compressible materials may be used. Gasket 705*a*, 705*b* may be manufactured by stamping, die cutting, laser cutting, molding, forming or any other process. In some embodiments, gasket 705*a*, 705*b* may be manufactured in an arrayed format and adhered with an adhesive to an arrayed panel of substrates 215. Substrates 215 and gaskets 705*a*, 705*b* may then be simultaneously singulated into individual units that are inserted into metal ground ring 110. In some embodiments, gasket 705*a*, 705*b* may be adhered to substrate 215 with an adhesive.

In yet further embodiments, gasket 705*a*, 705*b* may have a support layer disposed on one or both faying surfaces. In some embodiments, the support layer may only be disposed around perimeter of the gasket, and the gasket fingers may have no support layer. In other embodiments the one or more support layers may be configured to be removable after the gasket and/or gasket fingers are placed on or adhered to substrate 215 or dielectric frame 205.

In further embodiments an epoxy seal or design feature of dielectric frame 205 may be employed to prevent the flow of overmolding material between electrical contacts 120(1) . . . 120(8), as discussed above. In such embodiments, gasket 705*a*, 705*b* may not be used. In yet further embodiments, no seal may be used and overmold 230 may be allowed to flow between electrical contacts 120(1) . . . 120(8), as discussed in more detail below.

The next step of assembly may involve providing connector subassembly 700 (FIG. 4, step 440; FIG. 7). An example manufacturing process for one embodiment of connector subassembly 700 may be found in U.S. patent application Ser. No. 13/607,366 filed on Sep. 7, 2012 which is incorporated by reference herein in its entirety for all purposes. Connector subassembly 700 may include connector body 125 having tab 105 coupled to and extending away from one end of the body. Tab 105 may include metal ground ring 110 that may carry substrate 215. Substrate 215 may be electrically coupled to cable bundle 130. Metal ground ring 110 may have a window 705 through which a portion of substrate 215 is accessible and is configured to receive contact assembly 115.

The next step of assembly may involve integrating contact assembly 115 and gasket 705*a*, 705*b* into connector subassembly 700, (FIG. 4, step 450; FIG. 7). An example manufacturing process for one embodiment may be found in U.S. patent application Ser. No. 13/607,554 filed on Sep. 7, 2012 which was incorporated by reference above. Referring now to FIG. 7, one or more contact assemblies 115 and gaskets 705*a*, 705*b* may be integrated into electrical connector 100. Contact assembly 115 may be affixed to substrate 215 residing in window 705, and gasket 705*a*, 705*b* may be compressed between the contact assembly and the substrate. In some embodiments a hot bar soldering process may be employed to precisely position contact assembly 115 in window 705 of ground ring 110 and attach it to substrate 215 bonding pads 222(1) . . . 222(8) (see FIG. 2A). In other embodiments gasket 705*a*, 705*b* may not be used and an alternative seal may be formed with an epoxy or other material. In further embodiments, no seal may be formed between contact assembly 115 and substrate 215.

Figure 8:
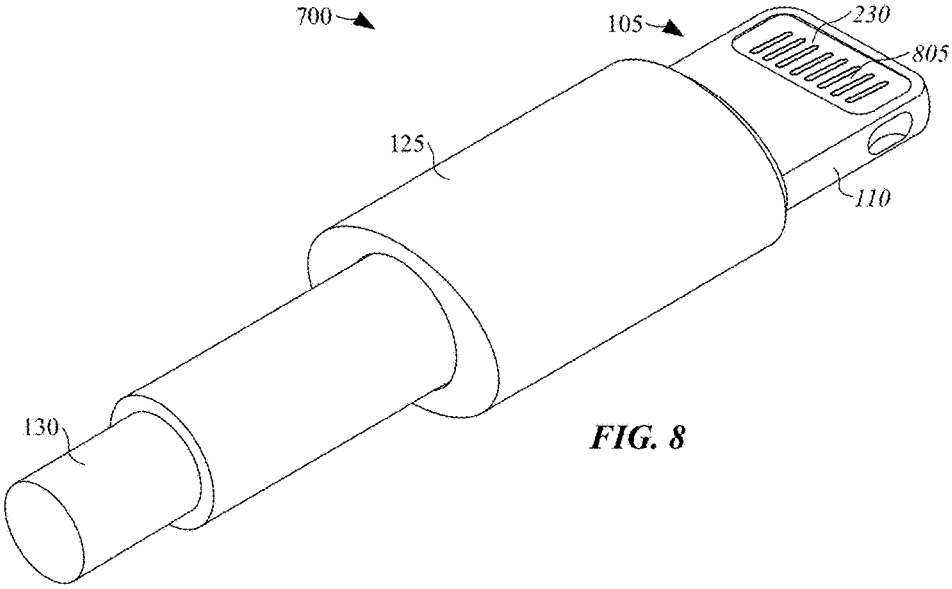
FIG. 8 is a rear perspective view of the fully assembled electrical connector shown in FIG. 1.

The next step of assembly may involve overmolding contact assembly 115, gasket 705*a*, 705*b* and substrate 215 (FIG. 4, step 460; FIG. 8). An example manufacturing process for one embodiment may be found in U.S. patent application Ser. No. 13/607,554 filed on Sep. 7, 2012 which was incorporated by reference above. A thermoplastic or similar dielectric overmold 230 may be formed around contact assembly 115 and within window 705 of ground ring 110. As depicted in FIG. 8, this process may provide a smooth and substantially flat mating surface 805 in a contact region of ground ring 110. In some embodiments, overmold 230 may be polyoxymethylene (POM). In other embodiments, overmold 230 may be a nylon-based polymer or other material. As discussed above, in some embodiments overmold 230 may be precluded from flowing between contacts 120(1) . . . 120(8) by gasket 705*a*, 705*b* or other material. In further embodiments, overmold 230 may be filled with an aerogel and allowed to flow between contacts 120(1) . . . 120(8).

Figure 9:
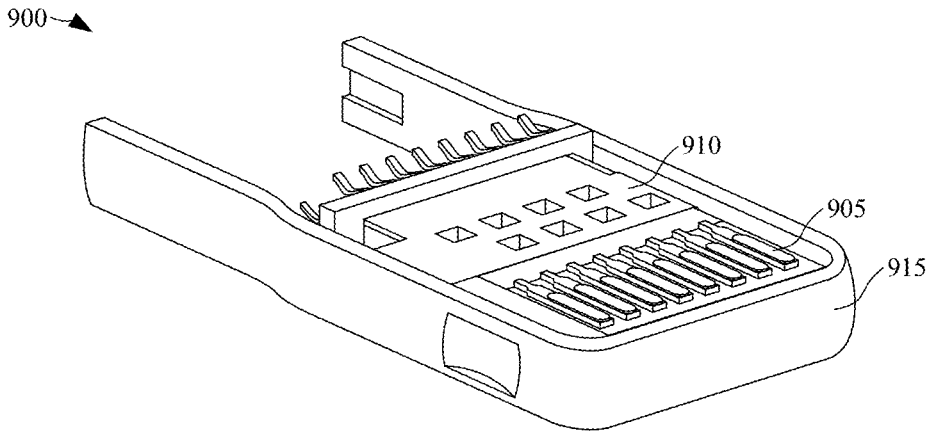
FIG. 9 is a front perspective view of a high-speed connector in a partially assembled condition according to an embodiment of the invention.
Figure 10:
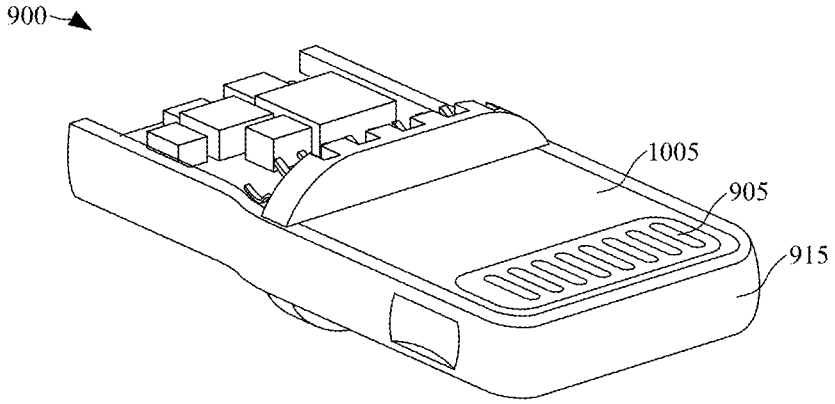
FIG. 10 is a front perspective view of the high-speed connector shown in FIG. 9 in a fully assembled condition.

It will be appreciated that the high-speed connector described herein is illustrative and that variations and modifications are possible. For instance, an alternative high-speed connector 900 is illustrated in FIG. 9. One or more leadframes 905 are insert-molded with plastic forming one or more contact assemblies 910. One or more contact assemblies 910 are disposed within a U-shaped frame 915. FIG. 10 shows the completed connector with overmold 1005 encapsulating one or more contact assemblies 910.

In some embodiments a compressible low dielectric constant gasket material may be disposed between portions of leadframes 905. In other embodiments the insert-molded plastic material may be filled with a silica aerogel or other material to create a low dielectric constant overmold. In further embodiments, overmold 1005 may be filled with a silica aerogel or other material to create a low dielectric constant overmold. One or more of these features may be used together to create a high-speed connector having low parasitic capacitance between electronic contacts. Other connector designs and variations are within the scope of this disclosure.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An electrical connector comprising:

a plurality of electrical contacts disposed in a dielectric frame having a perimeter encompassing the plurality of electrical contacts;

a substrate having a plurality of bonding pads, each bonding pad of the plurality of bonding pads being electrically coupled to a contact in the plurality of electrical contacts, wherein the substrate is positioned parallel and adjacent to the dielectric frame;

a gasket along the perimeter of the dielectric frame, disposed between the dielectric frame and the substrate such that an outline of the gasket encompasses the plurality of contacts;

an overmold encapsulating the dielectric frame and at least a portion of the substrate; and an air void disposed within the perimeter of the dielectric frame and between the dielectric frame and the substrate.

2. The electrical connector of claim 1 further comprising an air void disposed within the perimeter of the dielectric frame and between the dielectric frame and the substrate.

3. The electrical connector of claim 1 wherein portions of the gasket are disposed between each of the plurality of electrical contacts.

4. The electrical connector of claim 1 wherein the gasket comprises a low dielectric constant material that is compressible.

5. The electrical connector of claim 4 wherein the dielectric constant of the gasket is between 1.1-3.

6. The electrical connector of claim 1 wherein the dielectric frame comprises a low dielectric constant polymer.

7. The electrical connector of claim 1 wherein the gasket has a portion that extends beyond the perimeter of the dielectric frame.

8. An electrical connector comprising:

a substrate having a plurality of bonding pads formed in a contact area;

a dielectric frame disposed adjacent to the substrate in an oppositional relationship to the contact area;

a plurality of electrical contacts disposed in the dielectric frame, each electrical contact in the plurality of electrical contacts being coupled to a bonding pad in the plurality of bonding pads;

an overmold encapsulating at least a portion of the substrate and the dielectric frame and at least partially filling space in between upper portions of adjacent electrical contacts in the plurality of electrical contacts; and a gasket disposed between the substrate and the dielectric frame, the gasket forming a seal that surrounds the contact area between the substrate and the dielectric fame.

9. The connector set forth in claim 8 wherein each electrical contact in the plurality of electrical contacts is soldered to a bonding pad in the plurality of bonding pads at a solder joint and the seal forms an air gap between each adjacent solder joint.

10. The connector set forth in claim 9 wherein the plurality of contacts are spaced apart along a single row and the gasket includes first and second opposing rails that extend along a length of the row and a plurality of connectors extending between the first and second rails forming a plurality of openings, wherein each of the plurality of openings is aligned with a bonding pad from the plurality of bonding pads.

11. An electrical connector comprising:

a plurality of electrical contacts disposed in a dielectric frame, the dielectric frame comprising a perimeter encompassing the plurality of electrical contacts;

a substrate electrically coupled to the plurality of electrical contacts and disposed adjacent and parallel to the dielectric frame;

a gasket along the entire perimeter of the dielectric frame, disposed between the dielectric frame and the substrate, the gasket formed from a first compressible layer and a second reinforcement layer; and an overmold encapsulating the dielectric frame and at least a portion of the substrate.

12. The electrical connector of claim 11 wherein the gasket has a third reinforcement layer disposed on an opposite side of the compressible layer.

13. The electrical connector of claim 11 wherein portions of the gasket are disposed between each of the plurality of electrical contacts.

14. The electrical connector of claim 13 wherein the second reinforcement layer is disposed only along the perimeter of the dielectric frame.

15. A plug connector comprising:

a body;

a connector tab coupled to and extending away from the body, the connector tab including first and second surfaces;

a first plurality of external contacts carried by the tab at the first surface and a second plurality of external contacts carried by the tab at the second surface;

a first gasket formed around a perimeter of the first plurality of external contacts and a second gasket formed around a perimeter of the second plurality of external contacts; and an overmold dielectric material comprising an aerogel formed between each of the first plurality and each of the second plurality of external contacts.

16. The plug connector of claim 15 wherein the aerogel comprises a silica aerogel.

17. The plug connector of claim 15 wherein the first plurality of external contacts is disposed in a first dielectric frame and the second plurality of external contacts is disposed in a second dielectric frame.

18. The plug connector of claim 17 wherein the first and second dielectric frames comprise an aerogel.

19. A plug connector comprising:

a body;

a plurality of contacts carried by the body and electrically isolated from each other by an overmold dielectric material comprising silica aerogel formed between individual ones of the plurality of contacts;

a dielectric frame secured to each contact of the plurality of contacts; and a gasket formed around a perimeter of the plurality of contacts.

20. The plug connector of claim 19 further comprising a tab portion of the body coupled to and extending away from the body, the connector tab including first and second surfaces.

21. An electrical connector comprising:

a first plurality of electrical contacts disposed in a dielectric frame having a perimeter encompassing the plurality of electrical contacts, each contact in the first plurality of contacts having a first contact surface and a bonding surface opposite the first contact surface;

a substrate disposed adjacent and parallel to the dielectric frame, the substrate having a plurality of bonding pads;

an overmold encapsulating the dielectric frame and at least a portion of the substrate; and an air void disposed within the perimeter of the dielectric frame and between the dielectric frame and the substrate;

wherein the dielectric frame includes a design feature to prevent flow of overmold material into the air void and wherein each of the plurality of bonding pads is electrically coupled to a bonding surface of a contact in the first plurality of electrical contacts within the air void.

22. The electrical connector of claim 21 further comprising a body and connector tab extending away from the body, the connector tab comprising an exterior conductive surface that surrounds the first contact surface of each contact in the first plurality of electrical contacts in a first plane.

23. The electrical connector of claim 21 wherein each contact in the plurality of contacts includes a first bonding surface and a second bonding surface spaced apart from the first bonding surface.

24. The electrical connector of claim 21 wherein the dielectric frame is insert molded around the plurality of contacts and comprises a thermoplastic material.

25. The electrical connector of claim 21 wherein the dielectric frame comprises a liquid crystal polymer.

* * * * *